United States Patent [19]

Uchikata et al.

[11] Patent Number: 4,676,683

[45] Date of Patent: Jun. 30, 1987

[54] PLATEN SUPPORT STRUCTURE OF RECORDING APPARATUS

[75] Inventors: Yoshio Uchikata; Mineo Nozaki, both of Kawasaki; Osamu Asakura, Tokyo; Masasumi Nagashima, Yokosuka, all of Japan

[73] Assignee: Canon Kabushiki Kaisha, Tokyo, Japan

[21] Appl. No.: 887,973

[22] Filed: Jul. 24, 1986

Related U.S. Application Data

[63] Continuation of Ser. No. 689,945, Jan. 9, 1985, abandoned.

[30] Foreign Application Priority Data

Jan. 13, 1984 [JP] Japan ..... 59-4306

[51] Int. Cl.[4] ..... B41J 11/08

[52] U.S. Cl. ..... 400/656; 400/120

[58] Field of Search ..... 400/656, 657, 661, 120, 400/167

[56] References Cited

U.S. PATENT DOCUMENTS

| | | | |
|---|---|---|---|
| 1,994,309 | 3/1935 | Going | 400/661 |
| 2,450,727 | 10/1948 | Haushalter | 400/661 X |
| 2,787,210 | 4/1957 | Shepard, Jr. | 400/167 X |
| 3,442,365 | 5/1969 | Ragland, III et al. | 400/656 X |
| 4,215,946 | 8/1980 | Nakabo et al. | 400/661 X |
| 4,327,366 | 4/1982 | Schafter et al. | 400/656 X |
| 4,421,428 | 12/1983 | Noda et al. | 400/120 |

FOREIGN PATENT DOCUMENTS

| | | | |
|---|---|---|---|
| 568010 | 1/1933 | Fed. Rep. of Germany | 400/656 |
| 56-101858 | 8/1981 | Japan | 400/656 |
| 58-107381 | 6/1983 | Japan | 400/656 |
| 13579 | 1/1985 | Japan | 400/656 |

OTHER PUBLICATIONS

"Captive Resilient Platen" by Giedd et al, *IBM Technical Disclosure Bulletin,* vol. 23, No. 10, Mar. 1981.

*Primary Examiner*—Edgar S. Burr
*Assistant Examiner*—Moshe I. Cohen
*Attorney, Agent, or Firm*—Fitzpatrick, Cella, Harper & Scinto

[57] ABSTRACT

A platen support structure of a thermal transfer printer, for example, has a platen holder holding a platen, a frame supporting two ends of the platen holder, and an indexing mechanism for pivotally supporting the platen holder. The platen holder is curved in the inoperative mode of the printer and is flexed linearly in the operative mode. Clear printing can be performed without irregular line feed.

13 Claims, 4 Drawing Figures

PLATEN SUPPORT STRUCTURE OF RECORDING APPARATUS

This application is a continuation of application Ser. No. 689,945 filed Jan. 9, 1985, now abandoned.

BACKGROUND OF THE INVENTION

1. Field of the Invention

The present invention relates to a platen support structure in a recording apparatus such as a non-impact printer.

2. Description of the Prior Art

Non-impact printers are classified into those which directly print on thermal transfer paper and those which print through an ink ribbon. However, in either type of printer, a printing head is driven horizontally in contact with a printing surface to print characters or other images.

In a conventional platen support structure of a non-impact printe of this type, in order to prevent irregular printing on the printing surface, a platen holder is loosely fitted in mounting holes of a frame so that the platen can be moved or inclined for the distance or angle corresponding to the gap between the holder and the platen. Therefore, when the printing head is moved for printing, the printing head and the recording paper sheet and also an ink ribbon cause displacement or rubbing (friction). Then, the printed characters or images become unclear or the paper sheet is contaminated. In addition, the paper sheet is loosened between the paper feed mechanism and the printing mechanism and proper paper feed (line feed) cannot be performed.

SUMMARY OF THE INVENTION

It is an object of the present invention to provide a platen support mechanism suitable for a simple recording apparatus.

It is another object of the present invention to simplify the structure and assembly of a platen support mechanism.

It is still another object of the present invention to provide a simple platen support mechanism which can pivotally support a platen.

It is still another object of the present invention to keep a platen rigid in printing.

It is still another object of the present invention to keep the overall platen rigid in printing.

It is still another object of the present invention to provide a return pivotal force to a platen without using a separate spring member.

It is still another object of the present invention to provide a stable return pivotal force to a platen irrespective of pivot direction.

The above and other objects, features and advantages of the present invention will become apparent from the following description taken in conjunction with the accompanying drawings.

DETAILED DESCRIPTION OF THE PREFERRED EMBODIMENT

The preferred embodiment of the present invention will be described with reference to FIGS. 1 to 3.

Figure 1:
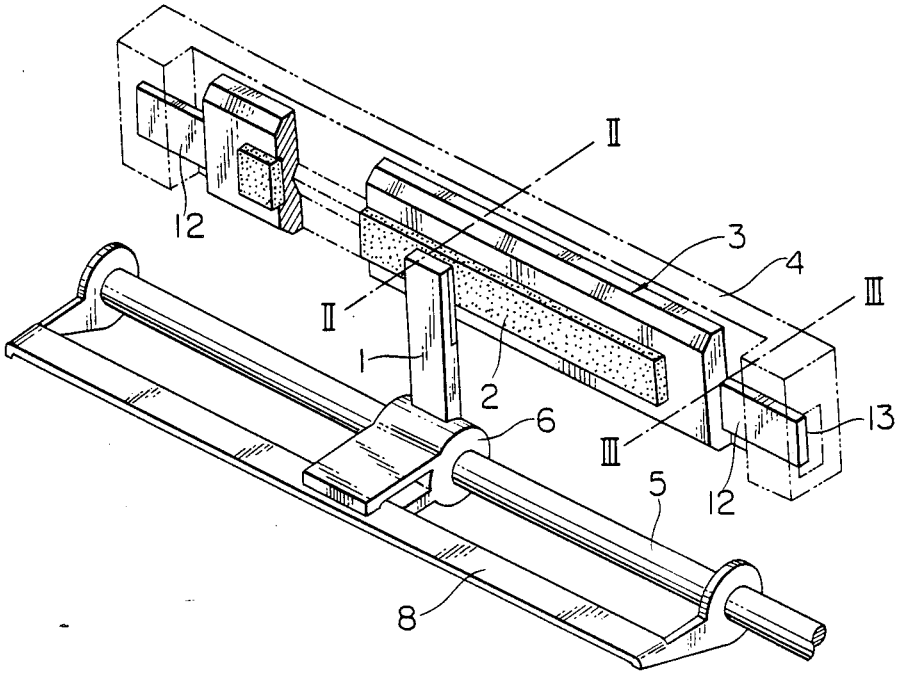
FIG. 1 is a partially omitted perspective view showing the main structure of a non-impact printer according to an embodiment of the present invention.

Referring to FIG. 1, an elongated thin rubber platen 2 against which a printing head 1 is urged through a recording paper sheet 15 is fixed to an elongated platen holder 3. The platen holder 3 is supported at a predetermined position by a frame 4 (part of the printer main body).

The printing head 1 is mounted on a carriage 6 which is moved along a guide shaft 5. The printing head 1 is pivotal between an urging position and a head-up position. When the head 1 is at the urging position, it is urged against the platen 2 through the recording paper sheet 15 by an actuator member 8 which is pivotal about the shaft 5. When the head 1 is at the head-up position, it is separated from the platen 2. The actuator member 8 is normally biased to the urging position (position illustrated in FIG. 1) by a spring (not shown). When paper is fed, a drive source such as a solenoid (not shown) is turned on to pivot the actuator member 8 to the head-up position against the spring.

Figure 2:
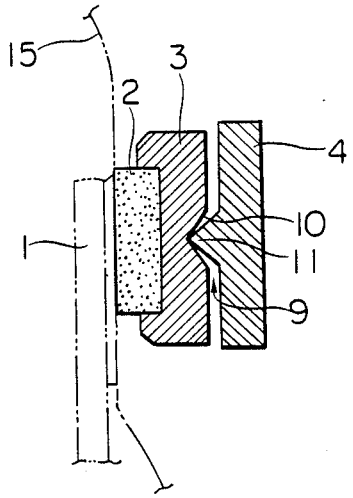
FIG. 2 is a sectional view along the line II—II in FIG. 1.

An indexing mechanism 9 for determining the pivot position and comprising a projection/recess engaging portion is incorporated between the rear surface of the platen holder 3 and the frame 4, as shown in FIG. 2. In the embodiment illustrated in FIG. 1, the indexing mechanism 9 consists of an elongated V groove 10 formed in the rear surface of the platen holder 3 and a V-shaped projection 11 formed on the frame 4.

The V groove 10 serves as a pivot portion in which a platen means consisting of the platen 2 and the platen holder 3 pivots about an axis extending along the longitudinal direction. The V groove 10 is formed at the central portion along the longitudinal direction of the platen holder 3 and at the central portion along the widthwise direction thereof. The groove 10 receives the projection 11 and the platen holder 3 is supported by this engagement.

The V groove 10 and the projection 11 can be continuously formed along the longitudinal direction of the platen. The groove can be divided into several portions and partial grooves can be formed separately. Furthermore, a V groove can be formed in the frame 4 and a projection can be formed on the platen holder 3.

With the indexing mechanism described above, since the platen holder 3 is held with respect to the frame 4 within a local range, i.e., the V groove, the platen holder 3 can be pivotally supported.

Figure 3:
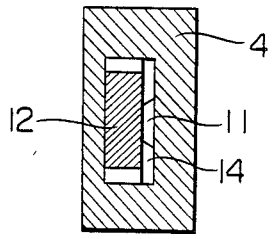
FIG. 3 is a sectional view along the line III—III in FIG. 1.
Figure 4:
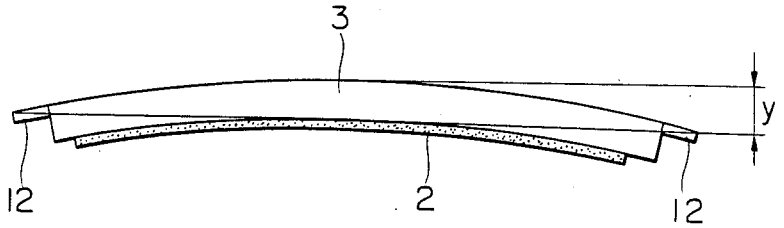
FIG. 4 is a top view of a platen holder.

As shown in FIGS. 1, 3 and 4, support arms 12 are formed at the two ends of the platen holder 3. The platen 2 and the platen holder 3 consist of a metal or a synthetic resin to have a substantially uniform radius of curvature corresponding to a distance y and extend non-linearly in a substantially arcuate shape. Therefore, the platen holder 3 can flex along the longitudinal direction. Through holes 14 are formed at the two ends of the frame 4 which correspond to the two ends of the platen holder 3. Thus, the platen holder 3 is supported by the frame 4 when the support arms 12 of the platen holder 3 are inserted in the through holes 14.

The platen holder 3 is supported by engaging the indexing mechanism 9 (consisting of the V groove 10 and the projection 11 in FIG. 2) and inserting the support arms 12 in the through holes 14. When the platen holder 3 is supported in this manner, it is flexed by a predetermined amount to provide a reaction force which stably holds the platen holder 3 against the pivotal movement of the indexing mechanism 9.

When the platen holder 3 is supported by the frame 4, the platen holder 3 is supported at the two ends and the central portion. The platen holder 3 is flexed to a linear shape and a reaction force is generated in the platen holder 3. This reaction force causes the V groove 10 of the platen holder 3 to be urged against the projection 11. Thus, the platen holder 3 is elastically supported in an operative state. This reaction force serves as a return pivotal force of the platen holder 3.

In the above embodiment, the pivot position of the platen holder 3 can be determined by the indexing mechanism 9. In addition, utilizing the elastic force of the platen holder 3, it is substantially kept in the operative state. Irregular urging and chattering of the platen can be effectively prevented with a simple structure. Then, rubbing (friction) and displacement of the printing head 1, the recording paper sheet and the ink ribbon are prevented, and clear printing can be performed. Contamination of the recording paper sheet due to rubbing against the ink ribbon can also be prevented. In addition, conventional shortcomings such that the paper sheet is loosened between the paper feed mechanism and the printing mechanism and proper feed (line feed) cannot be performed can be eliminated.

In the normal state, the platen holder 3 is curved. However, in the operative state, it is flexed in a linear state. Then, the platen holder 3 is kept stable.

In the indexing mechanism, a V groove can be formed on one member and a recess for receiving a plurality of balls (steel balls) can be formed in the other member. Thus, one member can be supported by the other member through these balls.

The platen holder 3 need not be curved. If the platen holder 3 is not curved, the support arms 12 can be curved or inclined with respect to the platen holder 3. The platen holder 3 must therefore have elasticity at least at a part thereof.

The platen holder 3 can be supported at three or more positions with respect to the frame 4.

The present invention can be similarly applied to impact printers other than thermal printers.

In the above embodiment, the platen 2 and the platen holder 3 are separate members. However, they can be formed integrally with each other.

What is claimed is:

1. A platen support apparatus for use in a recording device, comprising:

an elastic platen supporting member having front and back faces and defining a longitudinal axis, said supporting member supporting a platen on said front face, said elastic platen supporting member being arcuate in a free condition along at least a major portion of said longitudinal axis;

holding means engaging and holding said platen supporting member; and a receiving member engaging said back face of said platen supporting member and cooperating with said holding means to bend said platen supporting member from said arcuate free condition wherein an elastic reaction force is generated at said back face of said supporting member.

2. Apparatus according to claim 1, wherein said platen supporting member has two ends and includes at both said ends engaging portions that engage said holding means.

3. Apparatus according to claim 1, wherein said platen supporting member is pivotable with respect to said holding means.

4. Apparatus according to claim 1, wherein said receiving member includes a projection that engages a recess in said back face of said platen supporting member.

5. Apparatus according to claim 4, wherein said receiving member provides a center of rotation for said platen supporting member.

6. A platen support apparatus for use in a recording device, comprising:

an elastic platen supporting member having a pair of ends supporting a platen on a front face of said platen supporting member, said platen supporting member defining a longitudinal axis and being arcuate in a free condition along at least a major portion of said longitudinal axis;

a recess provided on a back face of said platen supporting member;

a frame having an engaging portion in engagement with both said ends of said platen supporting member to support said platen supporting member; and a projection on said frame to engage said recess, said projection engaging said back face of said platen supporting member and cooperating with said engaging portion to bend said platen supporting member from said arcuate free condition wherein an elastic reaction force is generated at said back face of said platen supporting member.

7. Apparatus according to claim 6, wherein said engaging portion are holes into which said ends of said platen supporting are insertable.

8. Apparatus according to claim 6, wherein said platen supporting member is pivotable with respect to said frame.

9. Apparatus according to claim 8, wherein said projection provides a center of rotation for said platen supporting member.

10. Apparatus according to claim 6, wherein the platen and said platen supporting member are integral.

11. A platen support apparatus for a recording device, comprising:

an elastic platen surrounding member, having a front face and a back face and defining a longitudinal axis, said supporting member supporting a platen on said front face and being arcuate in a free condition along at last a major portion of said longitudinal axis; and support means for supporting said platen supporting member, said support means including an engaging portion in engagement with said platen supporting member and a receiving portion contacting said back face of said platen supporting member and said receiving portion engaging said back face of said platen supporting member and cooperating with said engaging portion to bend said platen supporting member from said arcuate free condition wherein an elastic reaction force is generated at said back face of said platen supporting member, wherein said platen supporting member is held substantially flat and is pivotably supported with respect to said support means by the cooperation of said engaging and receiving portions.

12. Apparatus according to claim 11, wherein said engaging portion provides a center of rotation for said platen supporting member.

13. Apparatus according to claim 11, wherein the platen and said platen supporting member are integral.

* * * * *

UNITED STATES PATENT AND TRADEMARK OFFICE

CERTIFICATE OF CORRECTION

PATENT NO. : 4,676,683

DATED : June 30, 1987

INVENTOR(S) : YOSHIO UCHIKATA, ET AL.

It is certified that error appears in the above-identified patent and that said Letters Patent is hereby corrected as shown below:

COLUMN 1

Line 21, "printe" should read --printer--.

COLUMN 4

Line 32, "supporting are" should read --supporting member are--.

Line 42, "surrounding" should read --supporting--.

Signed and Sealed this

Seventeenth Day of November, 1987

*Attest:*

DONALD J. QUIGG

*Attesting Officer*

*Commissioner of Patents and Trademarks*